US007199647B2

(12) United States Patent
Tanizawa

(10) Patent No.: US 7,199,647 B2
(45) Date of Patent: Apr. 3, 2007

(54) CONSTANT CURRENT CIRCUIT

(75) Inventor: Yukihiko Tanizawa, Kariya (JP)

(73) Assignee: Denso Corporation, Kariya (JP)

( * ) Notice: Subject to any disclaimer, the term of this patent is extended or adjusted under 35 U.S.C. 154(b) by 130 days.

(21) Appl. No.: 11/053,945

(22) Filed: Feb. 10, 2005

(65) Prior Publication Data

US 2005/0212588 A1 Sep. 29, 2005

(30) Foreign Application Priority Data

Mar. 24, 2004 (JP) ..... 2004-086821

(51) Int. Cl.
*G05F 1/10* (2006.01)

(52) U.S. Cl. ..... 327/543; 327/513

(58) Field of Classification Search ..... 327/308, 327/512, 513, 535, 537, 539, 540, 541, 543
See application file for complete search history.

(56) References Cited

U.S. PATENT DOCUMENTS 5,654,663 A * 8/1997 McClure et al. ..... 327/530
6,377,113 B1 * 4/2002 Kanno ..... 327/543
6,496,057 B2 12/2002 Wada et al.

* cited by examiner

*Primary Examiner*—Jeffrey Zweizig
(74) *Attorney, Agent, or Firm*—Posz Law Group, PLC

(57) ABSTRACT

A constant current circuit in which a bias voltage of a field effect transistor is set includes a bias circuit which sets, as the bias voltage, a gate-source voltage $V_{GS}'$ corresponding to an intersecting point between an $I_D$- $V_{GS}$ characteristic curve at arbitrary first temperature and an $I_D$-$V_{GS}$ characteristic curve at arbitrary second temperature which is different from the first temperature in the $I_D$-$V_{GS}$ characteristic of the drain current $I_D$ to a gate-source voltage $V_{GS}$ of the field effect transistor. The bias circuit is comprised of a plurality of semiconductor resistors having substantially similar temperature coefficients so as to be able to transmit heat to each other.

2 Claims, 5 Drawing Sheets

CONSTANT CURRENT CIRCUIT

CROSS REFERENCE TO RELATED APPLICATION

This application is based upon, claims the benefit of priority of, and incorporates by reference the contents of, Japanese Patent Application No. 2004-86821 filed on Mar. 24, 2004.

FIELD OF THE INVENTION

The present invention relates to a constant current circuit using a field effect transistor.

BACKGROUND OF THE INVENTION

An exemplary constant current circuit using a field effect transistor entitled "Constant Current Generation Circuit, Constant Voltage Generation Circuit, Constant Voltage/Constant Current Generation Circuit, and Amplification Circuit" is disclosed in JP2002-132360A (refer to paragraphs 0067 to 0071 and FIG. 1). The reference numerals from this document will be referred to here while discussing the document. In the constant current generation circuit (10), a voltage Va applied across both ends of a resistor (18) is uniquely determined by the gate-source voltage of a transistor (13). A bias is set such that the transistor (13) operates in a saturation region. For the resistor (18), a two-layer polysilicon (polycrystalline silicon) having a low temperature coefficient is used. This configuration permits a constant current Ir to flow in the resistor (18), even if temperature changes or variations in a manufacturing process or the like exist in the transistor (13) and like components of the circuit.

However, in the technique disclosed in JP2002-132360A, the bias point of the transistor (13) as a component of the constant current generation circuit (10) is determined by the resistor (18) (refer to FIG. 1) under the precondition that the temperature coefficient of the resistor (18) is low. Consequently, to realize the resistor (18) having a low temperature coefficient, for example, another process such as adjustment of impurity concentration in a portion for forming the resistor (18) is necessary during a semiconductor manufacturing process. Since the resistor (18) cannot be formed by a general MOS IC manufacturing process in which a resistor having a low temperature coefficient is not mounted, it becomes more difficult to realize the constant current generation circuit as disclosed in JP2002-132360A with the general MOS IC.

SUMMARY OF THE INVENTION

In view of the above, it is in object to provide a constant current circuit capable of generating constant current without depending on a temperature change.

According to a first aspect, a gate-source voltage $V_{GS}'$ corresponding to an intersecting point between an $I_D$-$V_{GS}$ characteristic curve at an arbitrary first temperature and an $I_D$-$V_{GS}$ characteristic curve at an arbitrary second temperature which is different from the first temperature in the $I_D$-$V_{GS}$ characteristic curve of the drain current $I_D$ to a gate-source voltage $V_{GS}$ of a field effect transistor is set as a bias voltage by a bias circuit. The bias circuit is constructed by a plurality of semiconductor resistors having almost the same temperature coefficient and capable of transmitting heat to each other. With this configuration, since the gate-source voltage $V_{GS}'$ corresponding to an intersecting point between the $I_D$-$V_{GS}$ characteristic curve at the arbitrary first temperature and the $I_D$-$V_{GS}$ characteristic curve at the arbitrary second temperature which is different from the first temperature is set as a bias voltage of the bias circuit and the bias circuit is constructed by a plurality of semiconductor resistors having almost the same temperature coefficient and capable of transmitting heat to each other, even when the temperature of the field effect transistor or the ambient temperature changes, the bias voltage is not influenced by such a temperature change and does not change.

According to a second aspect, the plurality of semiconductor resistors construct a voltage dividing circuit which generates the bias voltage. Consequently, the bias circuit can be constructed by two semiconductor resistors. For example, by disposing the two semiconductor resistors constructing the voltage dividing circuit in positions close to each other on the same semiconductor substrate, the plurality of semiconductor resistors having almost the same temperature coefficient and capable of transmitting heat to each other can be relatively easily constructed.

According to a third aspect, the plurality of semiconductor resistors construct a D/A converter which generates the bias voltage, so that the bias voltage can be set by a digital value. Consequently, a deviation of the gate-source voltage $V_{GS}'$ corresponding to the intersecting point due to variations in characteristics of the field effect transistor, variations in the values of the plurality of semiconductor resistors, and the like can be absorbed. Thus, setting precision of the bias voltage can be improved.

According to a fourth aspect, the bias voltage is set on the basis of a voltage supplied from a band gap constant voltage source, so that the bias voltage can be set on the basis of the voltage having high setting precision. Since the setting precision of the bias voltage can be also improved, the temperature dependency can be eliminated more reliably.

In the above first aspect, the gate-source voltage $V_{GS}'$ corresponding to an intersecting point between an $I_D$-$V_{GS}$ characteristic curve at the arbitrary first temperature and an $I_D$-$V_{GS}$ characteristic curve at the arbitrary second temperature is set as a bias voltage of the bias circuit, and the bias circuit is constructed by a plurality of semiconductor resistors having almost the same temperature coefficient and capable of transmitting heat to each other. Consequently, even when the temperature of the field effect transistor or the ambient temperature changes, the bias voltage is not influenced by such a temperature change and does not change. Therefore, by such a bias voltage, the constant drain current $I_D$ can be supplied to a load connected to the drain of the field effect transistor irrespective of fluctuations in the drain-source voltage $V_{DS}$. The constant current can be generated without depending on a temperature change.

In the above second aspect, for example, by disposing the two semiconductor resistors constructing the voltage dividing circuit in positions close to each other on the same semiconductor substrate, the plurality of semiconductor resistors having almost the same temperature coefficient and capable of transmitting heat to each other can be relatively easily constructed. Therefore, the constant current can be relatively easily generated without depending on a temperature change.

In the above third aspect, a deviation of the gate-source voltage $V_{GS}'$ corresponding to the intersecting point due to variations in characteristics of the field effect transistor, variations in the values of the plurality of semiconductor resistors, and the like can be absorbed. Thus, setting precision of the bias voltage can be improved. Therefore, the constant current which does not depend on the temperature change can be generated more reliably.

In the above fourth aspect, the setting precision of the bias voltage can be also improved, so that the temperature dependency can be eliminated more reliably. Therefore, the constant current which does not depend on the temperature change can be generated more reliably.

BRIEF DESCRIPTION OF DRAWINGS

The above and other objects, features and advantages of the present invention will become more apparent from the following detailed description made with reference to the accompanying drawings. In the drawings:

FIG. 4A shows an example of a circuit constructed by using a band gap constant voltage source in place of Vcc2 of the circuit of FIG. 1A, and FIG. 4B shows an example of a circuit in which a field effect transistor of the circuit shown in FIG. 4A is replaced with a p-channel transistor;

FIG. 5A shows an example of a circuit constructed by using a D/A converter in place of a voltage dividing circuit of the circuit of FIG. 1A, and FIG. 5B shows an example of a circuit in which a field effect transistor of the circuit shown in FIG. 5A is replaced with a p-channel transistor;

FIG. 6A shows an example of a circuit constructed by using a band gap constant voltage source in place of Vcc2 of the circuit of FIG. 5A, and FIG. 6B shows an example of a circuit in which a field effect transistor of the circuit shown in FIG. 6A is replaced with a p-channel transistor;

DETAILED DESCRIPTION OF THE PREFERRED EMBODIMENTS

Figure 1A:
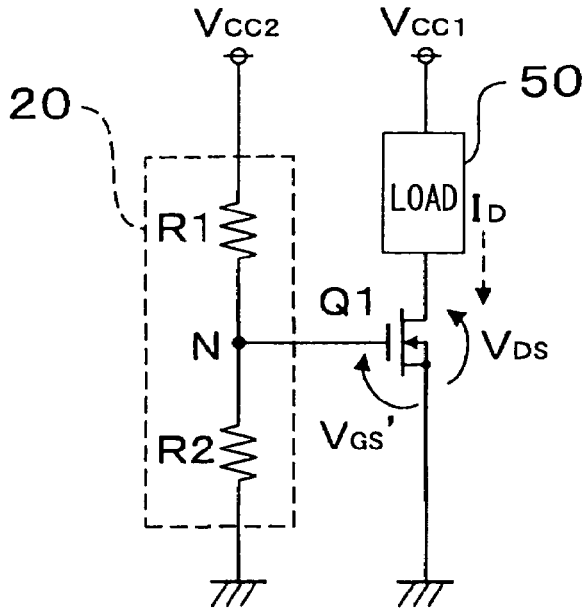
FIG. 1A is a circuit diagram of a constant current circuit according to a preferred embodiment.
Figure 1B:
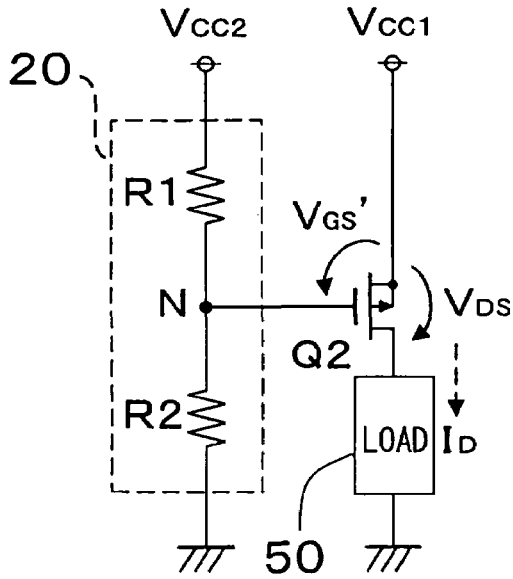
FIG. 1B illustrates a circuit diagram of the constant current circuit in which a field effect transistor in the circuit shown in FIG. 1A is replaced with a p-channel transistor.
Figure 2:
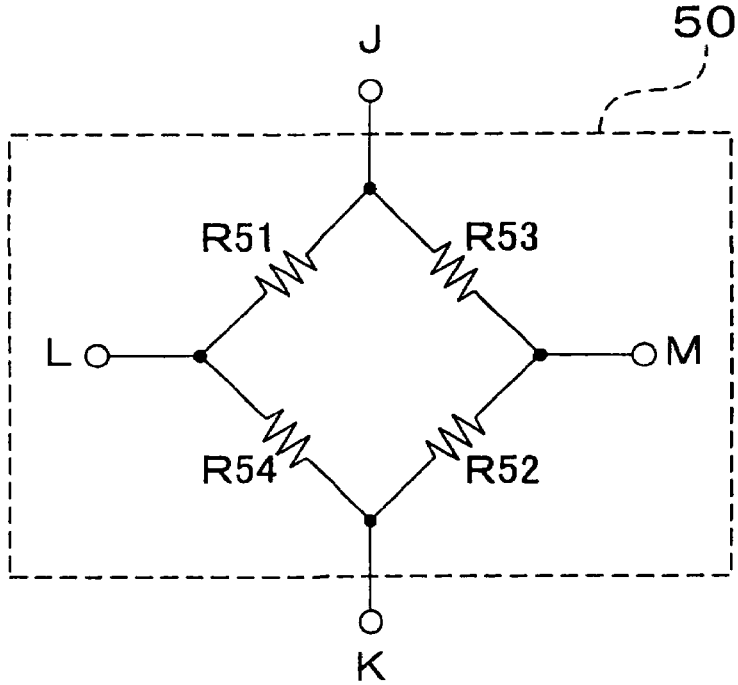
FIG. 2 is a circuit diagram of an exemplary load to which a constant current is supplied from the constant current circuit.

Embodiments of a constant current circuit will be described below with reference to the drawings. In the embodiment, an example of a circuit for supplying constant current (called "constant current circuit" below) to a sensor element (load) by applying the constant current circuit of the invention will be described with reference to FIGS. 1A and 1B to FIG. 8. First, the configuration of the constant current circuit will be described with reference to FIGS. 1A and 1B and FIG. 2. FIG. 1A is a circuit diagram of the constant current circuit, and FIG. 1B shows an example of a circuit in which a field effect transistor in the circuit illustrated in FIG. 1A is replaced with a p-channel transistor. FIG. 2 is a circuit diagram of a load to which constant current is supplied from the constant current circuit.

As shown in FIG. 1A, the constant current circuit is constructed mainly by a field effect transistor Q1 and a voltage dividing circuit 20 for determining bias voltage applied to the field effect transistor Q1, and can supply constant current to a load 50. The field effect transistor Q1 is an n-channel type MOSFET having a drain connected to the load 50, a source connected to earth potential (reference potential), and gate connected to the voltage dividing circuit 20. The voltage dividing circuit 20 constitutes a bias circuit.

The voltage dividing circuit 20 is constructed by two voltage dividing resistors R1 and R2 connected in series and is connected between a terminal to which a power source voltage Vcc2 is supplied and the ground (reference potential). The voltage dividing circuit 20 can output a voltage equal to Vcc2×R2/(R1+R2) obtained by dividing the power source voltage at a resistance ratio of the resistors R1 and R2, that is, a divided voltage from the connection node N of the voltage dividing resistors R1 and R2. In this embodiment, the output of the voltage dividing circuit 20 (at the connection node N) is connected to the gate of the field effect transistor Q1. The divided voltage of the power source voltage Vcc2 generated at the connection node N can be applied as a bias voltage ($V_{GS}'$) to the gate of the field effect transistor Q1.

As the voltage dividing resistors R1 and R2 constructing the voltage dividing circuit 20, for example, semiconductor resistors such as p-type or n-type diffusion resistors or polysilicon resistors are used. The voltage dividing resistors R1 and R2 are formed on a semiconductor substrate by a semiconductor manufacturing process of MOS or the like. In the embodiment, the voltage dividing resistors R1 and R2 are formed in positions close to each other on the same semiconductor substrate. With the configuration, for example, the concentration of impurity doped in the semiconductor manufacturing process and the like can be made almost the same in the resistors R1 and R2, so that the temperature coefficients of the resistors R1 and R2, which are almost the same can be set. By disposing the resistors R1 and R2 in positions close to each other, the resistors R1 and R2 can transmit heat to each other.

Consequently, the temperature environments of the voltage dividing resistors R1 and R2 become almost the same and the temperature coefficients of the resistors R1 and R2 become almost the same. Therefore, even if the ambient temperatures change, the resistance values of the voltage dividing resistors R1 and R2 can be similarly changed. In other words, even when the resistors R1 and R2 themselves have temperature dependency, the voltage dividing resistors R1 and R2 are formed on the semiconductor substrate so that their temperature dependencies are cancelled out. Thus, an output voltage as a divided voltage of the voltage dividing circuit 20 constructed by the voltage dividing resistors R1 and R2 can be prevented from depending on the temperature change.

The load 50 is connected between the terminal to which the power source voltage Vcc1 is supplied and the drain of the field effect transistor Q1. In the embodiment, for example, as shown in FIG. 2, a physical quantity sensor such as an acceleration sensor, pressure sensor, strain gauge, or the like in which resistors R51, R52, R53, and R54 as piezoresistance elements are formed in a bridge shape is used as the load 50. By connecting a terminal J of the load 50 to the power source voltage Vcc1 and connecting a terminal K to the drain of the field effect transistor Q1, the drain current $I_D$ which is made constant as will be described below can be supplied to the bridge circuit constructed by the resistors R51, R52, R53, and R54. With the configuration, an impedance change amount of the bridge circuit, which fluctuates according to an input of acceleration, pressure, or the like to be detected can be output as a sensor signal (voltage) from the terminals L and M of the load 50.

Figure 3A:
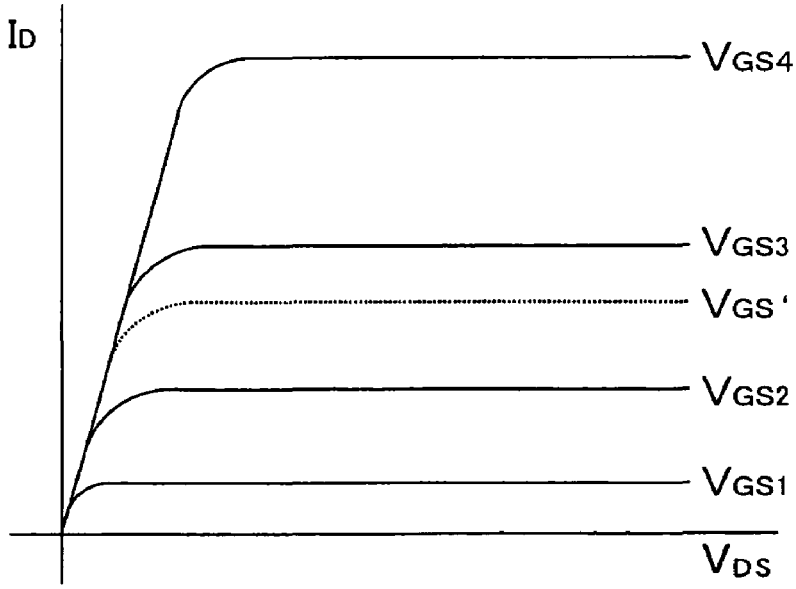
FIG. 3A is a diagram showing an example of an $I_D$-$V_{DS}$ characteristic of drain current $I_D$ to drain-source voltage $V_{DS}$ of a field effect transistor as a component of the constant current circuit according to the embodiment.

The bias voltage to the field effect transistor Q1 set by the voltage dividing circuit 20 will be described with reference to FIGS. 3A and 3B. FIG. 3A shows an example of the $I_D$-$V_{DS}$ characteristic of the drain current $I_D$ to the drain-source voltage $V_{DS}$ in the field effect transistor Q1, and FIG. 3B shows an example of the $I_D$-$V_{GS}$ characteristic of the drain current $I_D$ to the gate-source voltage $V_{GS}$ of the field effect transistor Q1.

First, as a precondition that the drain current $I_D$ of the field effect transistor Q1 connected as shown in FIG. 1A is maintained constant, a region in which the drain current $I_D$ is flat (saturation region) in the $I_D$-$V_{DS}$ characteristic shown in FIG. 3A has to be used. Consequently, based on the voltage Vcc1 to be applied to the load 50 and an impedance $Z_L$ of the load 50, the drain-source voltage $V_{DS}$ is set so that the drain current $I_D$ flows in the flat region ($V_{DS}$=Vcc1$-Z_L\times I_D$).

Figure 3B:
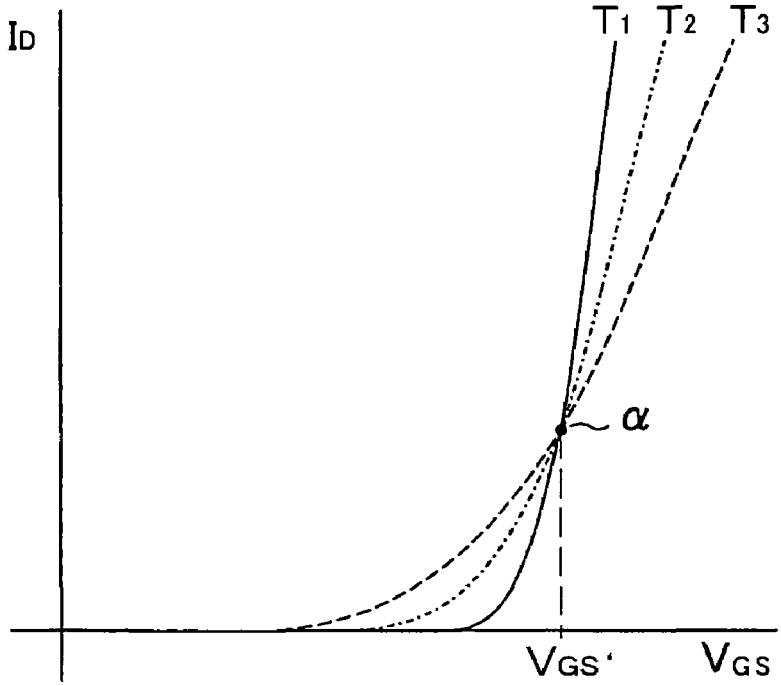
FIG. 3B is a characteristic diagram showing an example of the $I_D$-$V_{GS}$ characteristic of the drain current $I_D$ to gate-source voltage $V_{GS}$ of the transistor.

As shown in FIG. 3B, for example, the $I_D$-$V_{GS}$ characteristics using, as parameters, three different temperatures of low temperature $T_1$, normal temperature $T_2$, and high temperature $T_3$ (for example, $T_1$: −30° C., $T_2$: +25° C., and $T_3$: +100° C.) are measured, and a gate-source voltage $V_{GS}'$ corresponding to the point (intersecting point) α at which the $I_D$-$V_{GS}$ characteristic curves cross each other is obtained and used as a bias voltage. In such a manner, for example, the $I_D$-$V_{DS}$ characteristic curve as shown by the dotted line in FIG. 3A is obtained. Since the bias voltage $V_{GS}'$ does not fluctuate even when the temperature changes (refer to FIG. 3B), a voltage fluctuation caused by the temperature change does not occur in the drain current $I_D$ (refer to FIG. 3A).

Specifically, as shown in FIG. 3B, in the case where a voltage other than the voltage $V_{GS}'$ corresponding to the intersecting point α is set as the gate-source voltage, if the field effect transistor Q1 itself or the ambient temperature changes, the drain current $I_D$ fluctuates along the $I_D$-$V_{GS}$ characteristic curve which varies according to the temperature parameters $T_1$ to $T_3$. That is, in FIG. 3A, in the region where the drain current $I_D$ is constant and flat even if the drain-source voltage $V_{DS}$ fluctuates, voltages other than the $V_{GS}'$ fluctuate according to changes in the temperature parameters $T_1$ to $T_3$. In short, the drain current $I_D$ also fluctuates with a temperature change.

In contrast, as in the embodiment, the gate-source voltage $V_{GS}'$ corresponding to the intersecting point α of the three $I_D$-$V_{GS}$ characteristic curves obtained at the three temperature parameters $T_1$, $T_2$, and $T_3$ is set as the bias voltage to the field effect transistor Q1. Consequently, even when the ambient temperature or the like of the field effect transistor Q1 changes among $T_1$, to $T_3$, the gradient of the $I_D$-$V_{GS}$ characteristic curve just increases or decreases around the intersecting point α as a center axis, so that the intersecting point α itself does not fluctuate and the gate-source voltage $V_{GS}'$ corresponding to the point does not fluctuate. Therefore, in the case where the gate-source voltage $V_{GS}'$ is set to the bias voltage by the voltage dividing circuit 20, irrespective of the ambient temperature or the like of the field effect transistor Q1, the drain current $I_D$ can be obtained in the flat region according to the $I_D$-$V_{DS}$ characteristic curve shown in FIG. 3A. That is, the constant current circuit having no temperature dependency can be realized.

Although three $I_D$-$V_{GS}$ characteristic curves are obtained at the three different temperatures of the low temperature $T_1$, normal temperature $T_2$, and high temperature $T_3$ and the intersecting point α of the three curves is determined in the embodiment, alternately, the intersecting point α may be also determined from the $I_D$-$V_{GS}$ characteristic curve at an arbitrary first temperature and the $I_D$-$V_{GS}$ characteristic curve at an arbitrary second temperature which is different from the first temperature by a combination of, for example, "low temperature $T_1$ and normal temperature $T_2$", "normal temperature $T_2$ and high temperature $T_3$", and "low temperature $T_1$ and high temperature $T_3$". In such a manner, the gate-source voltage $V_{GS}'$ at the intersecting point α can be obtained from a smaller amount of measurement data.

In the example of the constant current circuit described with reference to FIG. 1A, the field effect transistor Q1 is an n-channel type MOSFET. However, it is also possible to construct a constant current circuit by using a p-channel type MOSFET as shown in FIG. 1B. Specifically, in the case of using a field effect transistor Q2 as a p-channel type MOSFET, except that the source of the field effect transistor Q2 is connected to the terminal to which the power source voltage Vcc1 is supplied and the load 50 is connected between the drain of the field effect transistor Q2 and the earth (reference potential), a constant current circuit which is constructed in substantially the same manner as the circuit shown in FIG. 1A and which also does not have the temperature dependency can be realized.

In the constant current circuit, as shown in FIG. 3B, the gate-source voltage $V_{GS}'$ corresponding to the intersecting point of the $I_D$-$V_{GS}$ characteristic curves which are different according to the temperature parameters $T_1$ to $T_3$ in the $I_D$-$V_{GS}$ characteristic of the drain-current $I_D$ to the gate-source voltage $V_{GS}$ of the field effect transistors Q1 and Q2 is set as a bias voltage by the voltage dividing circuit 20. The voltage dividing circuit 20 is constructed by the voltage dividing resistors R1 and R2 having almost the same temperature coefficient and capable of mutually transmitting heat. With the configuration, even when the temperature of the field effect transistors Q1 and Q2 and the ambient temperature change, the bias voltage does not change without being influenced by the temperature change. Therefore, by such a bias voltage, the constant drain current $I_D$ can be supplied to the load 50 irrespective of the fluctuations in the drain-source voltage $V_{DS}$ for the load 50 connected to the drains of the field effect transistors Q1 and Q2. The constant current can be generated without depending on the temperature change.

Although the power source voltage Vcc2 to be supplied to the voltage dividing circuit 20 is provided separately from the power source voltage Vcc1 to be supplied to the load 50 in the example of the constant current circuit shown in FIGS. 1A and 1B, the voltages may be supplied from the same power source. Further, as shown in FIGS. 4A and 4B, another configuration may be employed in which the reference voltage Vref supplied via a band gap constant voltage source 30 is applied to the voltage dividing circuit 20 while using the same power source voltage Vcc1 as the power source voltages.

Figure 4A:
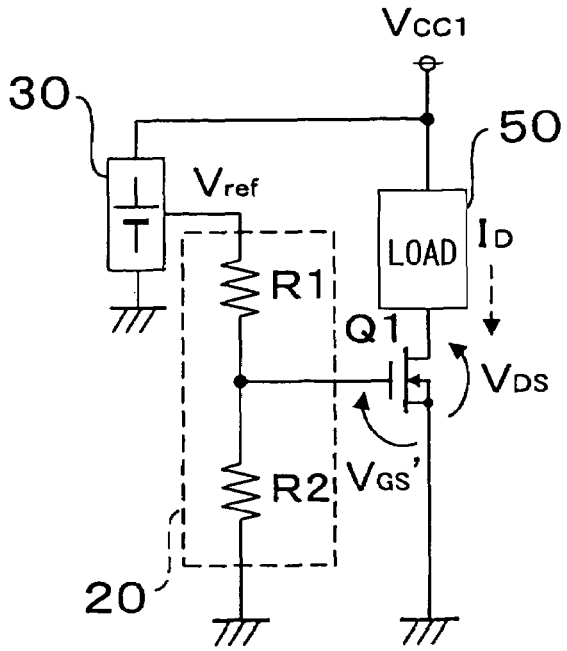
FIGS. 4A and 4B are circuit diagrams of another exemplary configuration of the constant current circuit according to another embodiment.
Figure 4B:
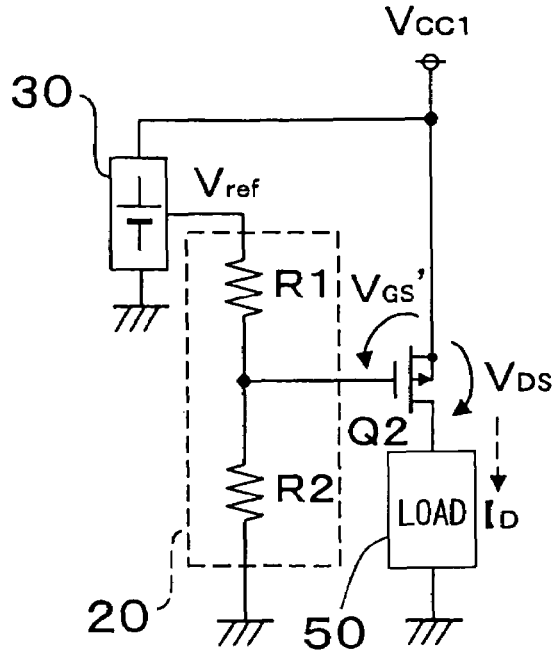

Specifically, as shown in FIG. 4A, the circuit is constructed by using the band gap constant voltage source 30 in place of Vcc2 in the circuit shown in FIG. 1A or, as shown in FIG. 4B, the circuit is constructed by using the field effect transistor of the circuit shown in FIG. 4A in place of a p-channel transistor. With the configuration, the bias voltage obtained by the voltage dividing circuit 20 is set on the basis of the reference voltage Vref of high precision supplied from the band gap constant voltage source 30, so that setting precision of the bias voltage can be improved. Therefore, the gate-source voltage $V_{GS}'$ described with reference to FIG. 3B can be set with high precision, so that the temperature dependency can be eliminated more reliably, and the constant current which does not depend on the temperature change can be generated more reliably.

Figure 8:
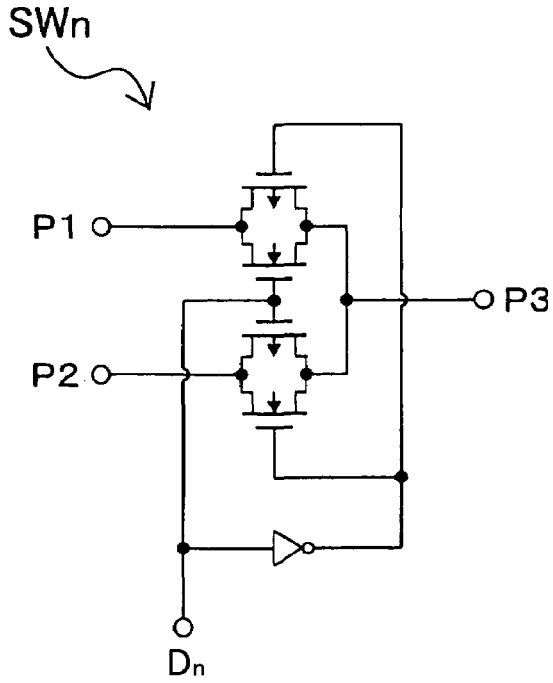
FIG. 8 is a circuit diagram showing a configuration example of a change-over switch illustrated in FIG. 7.

As another configuration example of the constant current circuit of the embodiment, a configuration in which a D/A converter 40 is used in place of the voltage dividing circuit 20 as the bias circuit will be described with reference to FIGS. 5A and 5B to FIG. 8. FIGS. 5A and 5B and FIGS. 6A and 6B are circuit diagrams showing the case where the D/A converter 40 is used as a bias circuit. FIG. 7 is a circuit diagram showing the D/A converter 40. FIG. 8 is a circuit diagram showing a change-over switch SWn as a component of the D/A converter 40.

Figure 5A:
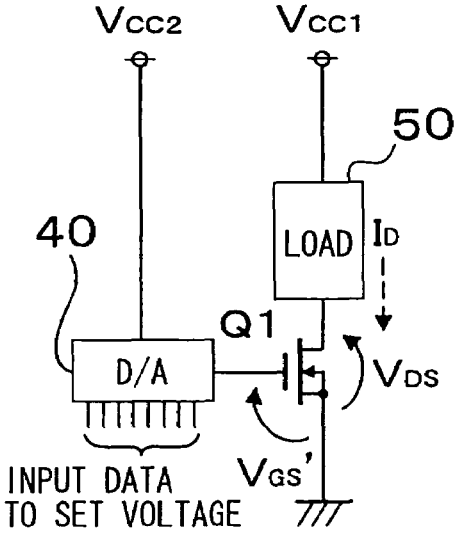
FIGS. 5A and 5B are circuit diagrams of another exemplary configuration of the constant current circuit according to another embodiment.
Figure 5B:
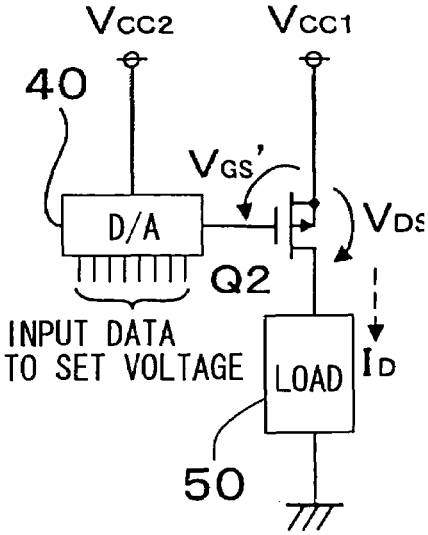

As shown in FIGS. 5A and 5B, the D/A converter 40 corresponding to the bias circuit outputs a voltage obtained by decreasing a voltage supplied from the terminal to which the power source voltage Vcc2 is supplied on the basis of voltage setting data input as a digital value, and the output is connected to the gates of the field effect transistors Q1 and Q2. With the configuration, the bias voltage according to the voltage setting data which is input can be applied to the field effect transistors Q1 and Q2. Consequently, even if variations exist in the operating characteristics peculiar to the field effect transistors Q1 and Q2, the bias voltage coping with the variations can be set.

Specifically, variations exist in the operating characteristics peculiar to the field effect transistors Q1 and Q2 as components of the constant current circuit shown in FIGS. 1A and 1B and FIGS. 4A and 4B and variations to a certain degree also exist in the resistance values and the like of the voltage dividing resistors R1 and R2 as components of the voltage dividing circuit 20. Consequently, in such a constant current circuit, it is necessary to set a proper bias voltage by finely adjusting the values of the voltage dividing resistors R1 and R2 of the voltage dividing circuit 20 in accordance with the intersecting point a of the temperature characteristics (refer to FIG. 3B) of the field effect transistors Q1 and Q2 to be mounted. However, the resistance values of the voltage dividing resistors R1 and R2 themselves as components of the voltage dividing circuit 20 include an error, so that it is not easy to set the bias voltage with high precision.

Therefore, by constructing the bias circuit by the D/A converter 40 as shown in the configuration examples shown in FIGS. 5 and 6, a deviation of the gate-source voltage $V_{GS}'$ corresponding to the intersecting point $\alpha$ due to variations in the characteristics of the field effect transistors Q1 and Q2, variations in the values of the voltage dividing resistors R1 and R2 constructing the voltage dividing circuit 20, and the like can be absorbed, so that setting precision of the bias voltage can be improved. Therefore, the constant current which does not depend on a characteristic change can be generated more reliably.

Figure 6A:
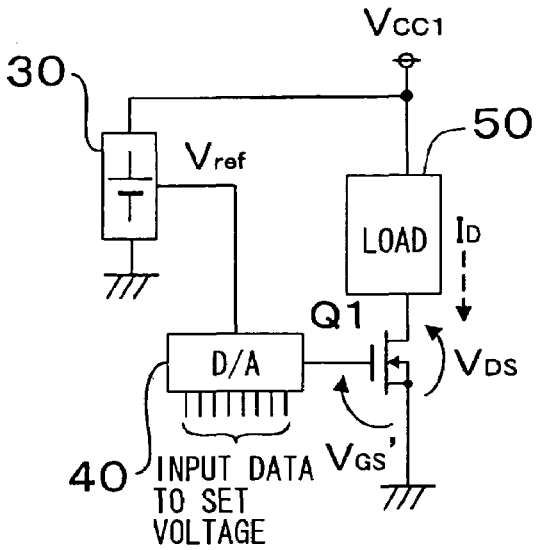
FIGS. 6A and 6B are circuit diagrams of another exemplary configuration of the constant current circuit according to another embodiment.
Figure 6B:
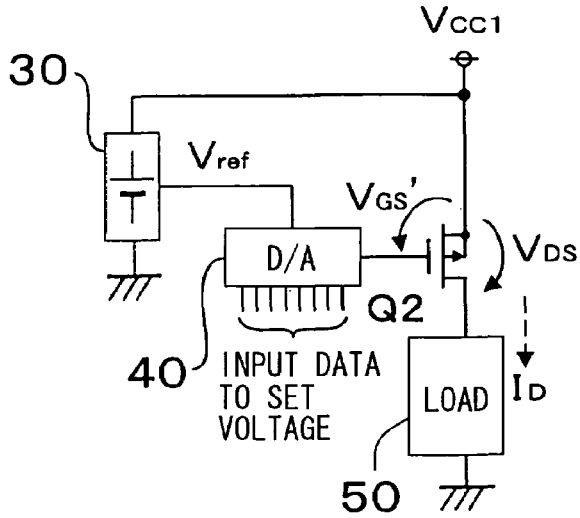
Figure 7:
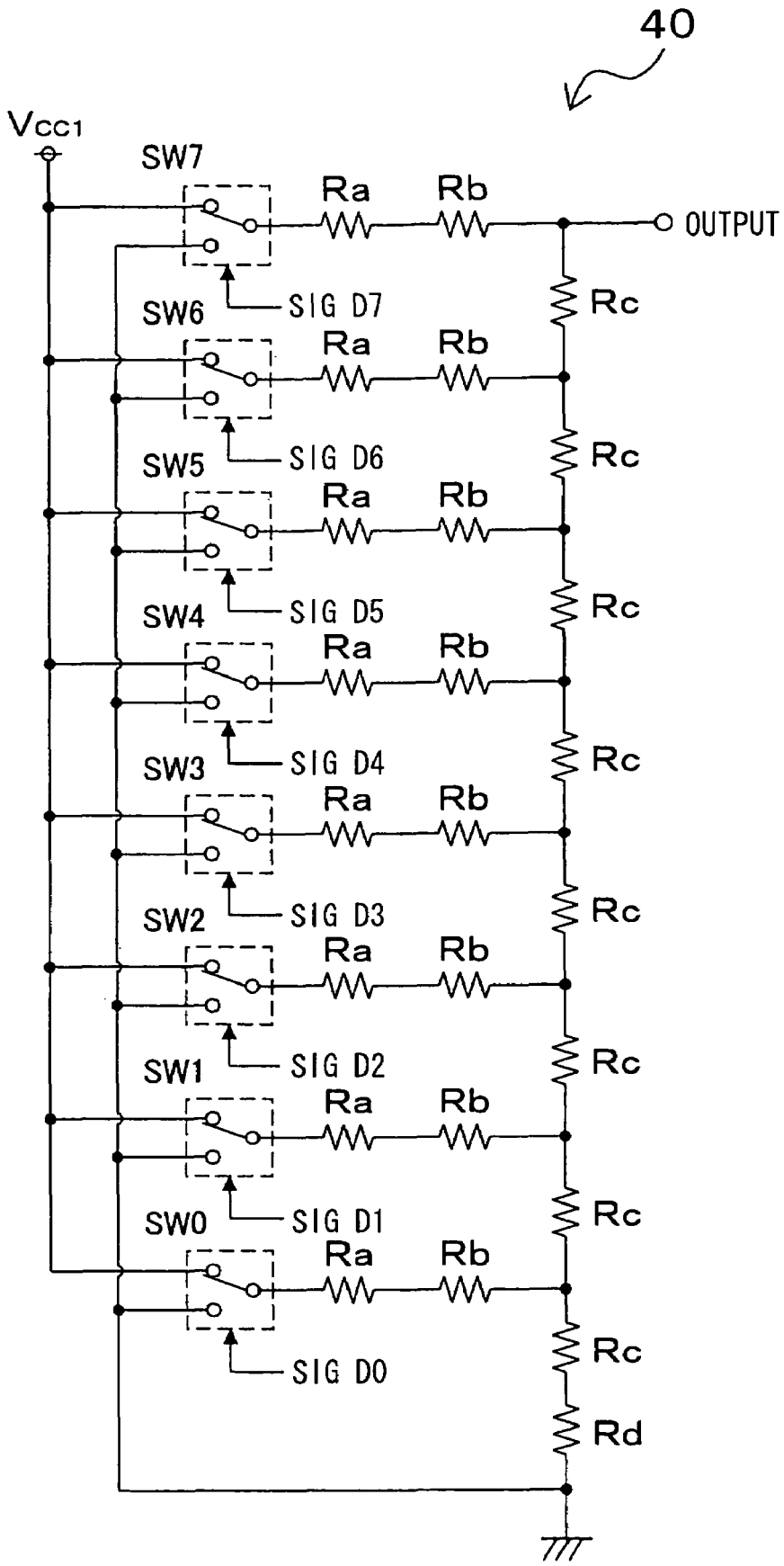
FIG. 7 is a circuit diagram an exemplary configuration for the D/A converter illustrated in FIGS. 5 and 6.

Further, as shown in FIGS. 6A and 6B, the single power source voltage Vcc may be used without dividing the power source voltage to the power source voltage Vcc1 to be supplied to the load 50 and the power source voltage Vcc2 to be supplied to the D/A converter 40, and the reference voltage Vref to be supplied via the band gap constant voltage source 30 may be applied to the D/A converter 40. In the circuit example shown in FIG. 6B, the p-channel field effect transistor Q2 is used in place of the field effect transistor Q1 of the circuit shown in FIG. 6A.

With the configuration, the bias voltage according to the voltage setting data which is input is output from the D/A converter 40 on the basis of the reference voltage Vref of high precision supplied from the band gap constant voltage source 30, so that the setting precision of the bias voltage can be improved. Therefore, the gate-source voltage $V_{GS}'$ described with reference to FIG. 3 can be set with high precision, so that the temperature dependency can be eliminated more reliably, and the constant current which does not depend on a temperature change can be generated more reliably.

The D/A converter 40 is constructed in, for example, an R-2R ladder shape and its circuit example is shown in FIG. 7. In the embodiment, each bit is constructed by resistors Ra, Rb, and Rc and a change-over switch SWn (n denotes 0 to 7, refer to FIG. 8 for the circuit configuration) and the configurations of eight bits are ladder-connected so that the power source voltage Vcc1 as an input voltage can be decreased according to a value expressed by digital data (D0 to D7) of eight bits and the resultant voltage can be output. The resistors Ra, Rb, and Rc are set to have the same resistance value (R). The resistors Ra and Rb are connected in series to the output (2R) and the resistor Rc is connected in parallel with the output so as to form a ladder shape. Consequently, the D/A converter 40 is generally called a D/A converter of the "R-2R ladder type".

The resistors Ra to Rd constructing the D/A converter 40 are in positions close to each other on the same semiconductor substrate in a manner similar to the voltage dividing resistors R1 and R2. With the configuration, the concentration of impurity to be doped and the like in the semiconductor manufacturing process can be made almost the same in the resistors Ra to Rd, so that the temperature coefficients can be set to be almost the same. By positioning the resistors Ra to Rd close to each other, they can transmit heat to each other. Consequently, the temperature environments of the resistors Ra to Rd constructing the D/A converter 40 become almost the same and the temperature coefficients become almost the same. Even if the ambient temperature of the D/A converter 40 changes, the resistance values can be fluctuated in almost the same manner. That is, in the D/A converter 40 according to the embodiment, even when the resistors Ra to Rd themselves constructing the D/A converter 40 have temperature dependency, they are formed on the semiconductor substrate so as to cancel out their temperature dependencies, thereby preventing the output voltage from depending on the temperature change.

Although the physical quantity sensor in which a bridge circuit is constructed by resistors has been described as the load 50 in the foregoing embodiment, as long as a circuit requires supply of constant current from the outside, any electronic circuit such as a circuit to which constant current is supplied and which generates a reference voltage at both ends of a predetermined resistor or the like and a resistor itself as an electronic part can be an object of a load.

What is claimed is:

1. A constant current circuit in which a bias voltage of a field effect transistor is set, the bias voltage enabling a constant drain current to be supplied to a load connected to a drain of the field effect transistor irrespective of fluctuations in a drain-source voltage, comprising:

a bias circuit which sets, as the bias voltage, a gate-source voltage corresponding to an intersecting point between an ID-VGS characteristic curve at arbitrary first temperature and an ID-VGS characteristic curve at arbitrary second temperature which is different from the first temperature in the ID-VGS characteristic of the drain current to a gate-source voltage of the field effect transistor, wherein the bias circuit is comprised of a plurality of semiconductor resistors having substantially similar temperature coefficients so as to be able to transmit heat to each other, wherein the plurality of semiconductor resistors construct a D/A converter which generates the bias voltage, wherein the bias voltage is set on the basis of a voltage supplied from a band gap constant voltage source.

2. The constant current circuit according to claim 1, wherein the plurality of semiconductor resistors construct a voltage dividing circuit which generates the bias voltage.

* * * * *